United States Patent [19]

Duescher

[11] 4,261,690

[45] Apr. 14, 1981

[54] PUMP

[75] Inventor: Wayne O. Duescher, St. Paul, Minn.

[73] Assignee: FisHair Incorporated, St. Paul, Minn.

[21] Appl. No.: 29,395

[22] Filed: Apr. 12, 1979

[51] Int. Cl.[3] ..... F04B 43/00

[52] U.S. Cl. ..... 417/479; 417/510; 417/550; 366/349

[58] Field of Search ..... 417/479, 510, 550; 366/349, 276, 277

[56] References Cited

U.S. PATENT DOCUMENTS

| | | | |
|---|---|---|---|
| 2,672,101 | 3/1954 | Shields | 417/550 |
| 2,745,349 | 5/1956 | Tavola | 417/506 |
| 3,368,723 | 2/1968 | Hardeman | 366/276 |
| 3,945,770 | 3/1976 | Welker | 417/479 |

FOREIGN PATENT DOCUMENTS

| | | | |
|---|---|---|---|
| 334922 | 9/1930 | United Kingdom | 417/479 |

*Primary Examiner*—Robert W. Jenkins

*Attorney, Agent, or Firm*—Hill, Van Santen, Steadman, Chiara & Simpson

[57] ABSTRACT

A pump has a reciprocably driven rod disposed in a quantity of fluid to be pumped, there being an outlet from the fluid chamber. A pair of elements respectively disposed at the outlet opening and on the end of the rod are separable and jointly define a pumping cavity which is filled when the elements are separated. When the elements are brought together, pumping is achieved in that one of the elements is yieldably compressible so as to reduce the size of the pumping cavity to force out a drop of fluid. A stirrer is disposed near the above-mentioned elements, and reciprocatory motion of the rod is transferred to a one-way clutch to provide incremental rotation of the stirrer.

17 Claims, 6 Drawing Figures

FIG. 5
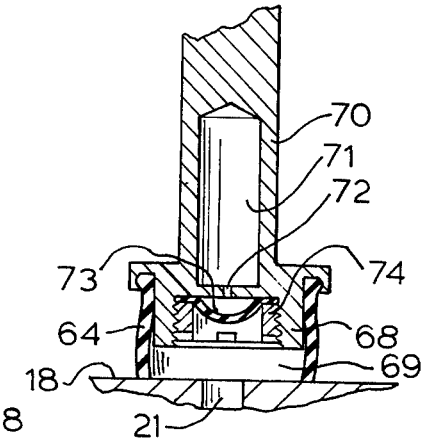
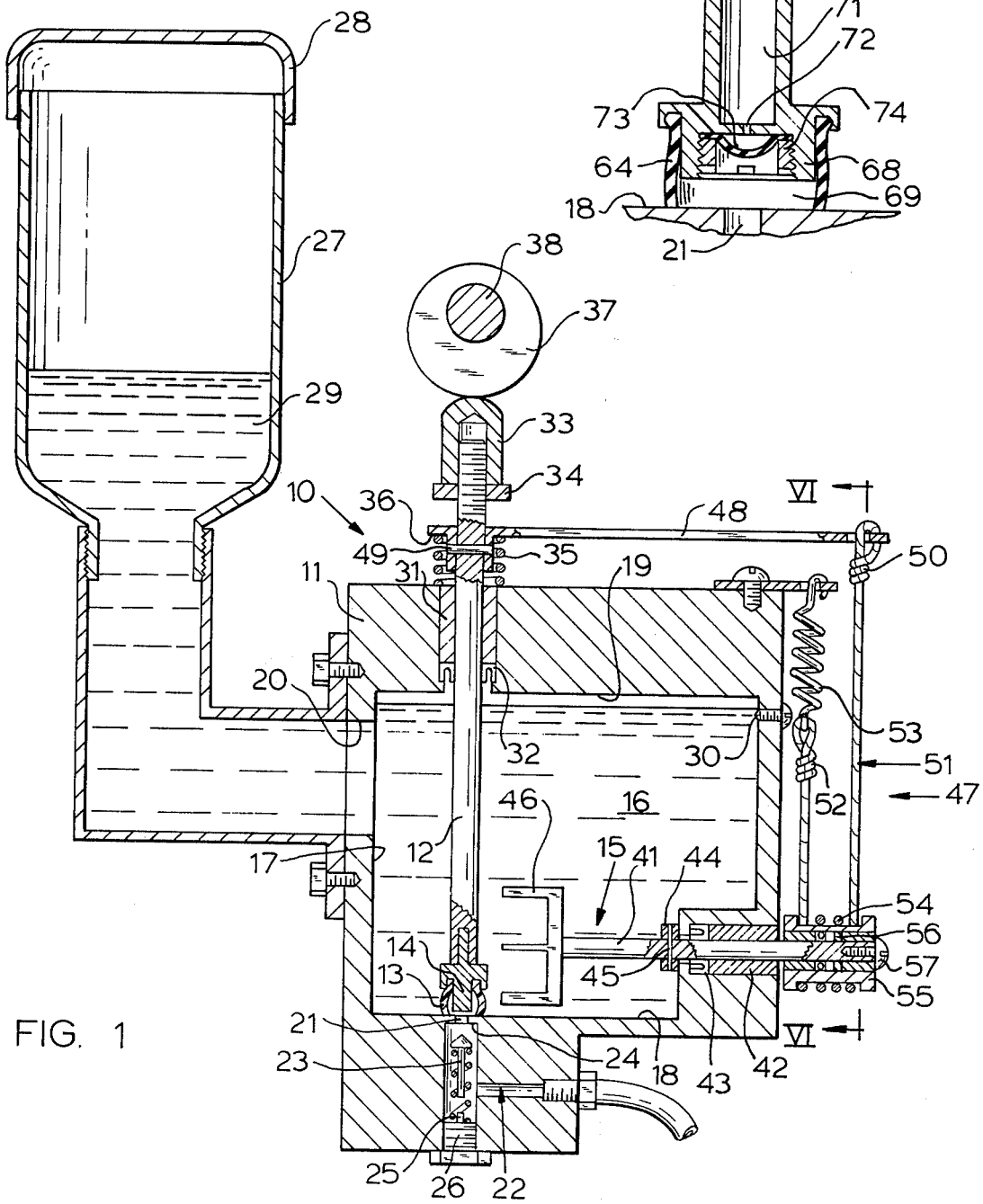
FIG. 1

PUMP

BACKGROUND OF THE INVENTION

1. Field of the Invention

This invention relates to a pump, and more specifically to a pump having a pumping cavity defined by separable elements, at least one of which is resiliently compressible.

2. Prior Art

In the present instance, it is necessary to provide a pump that is capable of handling high viscosity latex fluids. One type of latex pump handles one-micron spheres of latex separated by chemicals or ionization. Pumps constructed on a piston principle cause agglomeration of latex which in turn promotes sticking of such pistons. Similarly, in gear pumps, the close clearances necessary ultimately result in seizure of the moving parts. Peristaltic pumps lack an adequate high pressure capability, and their principle produces questionable metering capability. Diaphragm pumps have a large volume of fluid in the pumping cavity and rely on check valves for fluid entry. With such devices, there is a possibility that air or vapor may enter the pumping cavity, thus seriously impairing performance. Vibration pumps using linear induction motors to reciprocate traveling rods have large chambers, and thus also are insensitive to air entrapment, and a few drops of air can drastically offset pumping and/or metering action.

SUMMARY OF THE INVENTION

According to the invention, there is provided a pair of separable elements which jointly define a rather small pumping cavity, one of the elements being compressible to reduce the size of the pumping cavity, thereby forcing fluid out through an outlet opening in one of the elements. Such elements are moveable toward and away from each other and are disposed in a supply of the fluid to be pumped. In a preferred embodiment, one of the elements comprises a flat surface having an outlet opening, and the other element comprises a reciprocable sleeve of resilient material moveable endwise into encircling engagement with the flat surface around the outlet opening, there being a mandrel within the tubular sleeve which does not extend to the end of the sleeve, thereby defining a small pumping cavity, typically having a size of a large drop of fluid. Other aspects include a stirring mechanism which is automatically driven at a rate which is a function of the rate of pump strokes, and which thus is a function of the pumping rate.

Accordingly, it is an object of the present invention to provide a reliable pump capable of handling latex fluids or other high viscosity liquids while still having a capability to handle low viscosity fluids.

Another object of the present invention is to provide a pump wherein the size of the quantity pumped per stroke or cycle is independent of the speed of the plunger that supports one of the elements, which is independent of the amount of free travel that the plunger has, which is independent of viscosity, and which is independent of air or debris in the supply of fluid, such as agglomerates of rubber particles.

A further object of the present invention is to provide a pump that can have its supply filled by gravity without any externally pressurized fluid system being required, whereby there is no need for any pressure seals around any moveable components.

Yet another object of the present invention is to provide a high pumping pressure only during the final portion of the movement of a rod or plunger, and which exists only in the outlet flow section of the device.

A still a further object of the present invention is to utilize a self-relieving construction for avoiding any excessive pressures.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

ON THE DRAWINGS

FIG. 1 is a cross-sectional view, partly schematic, of a pump provided in accordance with the present invention;

FIG. 5, appearing on Sheet 1, is a fragmentary cross-sectional view which may be used in place of the structure of FIGS. 3 and 4.

AS SHOWN ON THE DRAWINGS

Figure 3:
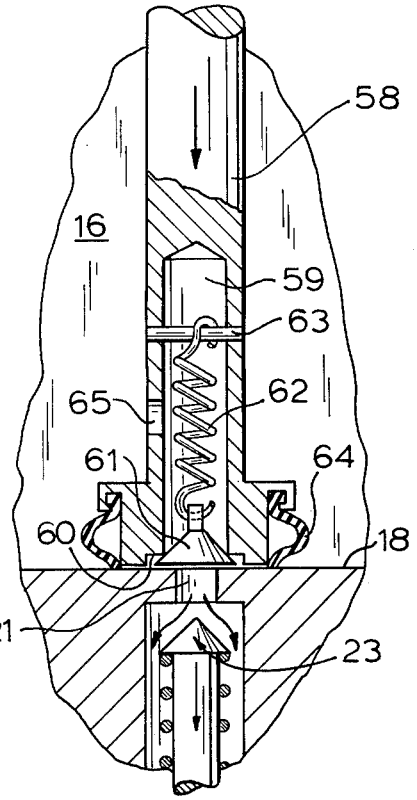
FIGS. 3 and 4 illustrate an added feature that may be included with FIG. 2, and shown at different points in an operating cycle.

The principles of the present invention are particularly useful when embodied in a pump such as is illustrated in FIG. 1, generally indicated by the numeral 10. The pump 10 includes a housing 11 within which a rod 12 is slidably supported, and to which a resilient tubular sleeve 13 and a mandrel 14 are secured. Adjacent thereto, a moveable stirrer 15 is disposed which is also supported by the housing 11.

The housing 11 has a fluid chamber 16 defined by an inner wall which here includes a vertical portion 17, an upwardly facing portion 18, the chamber 16 being closed at its upper side 19. The fluid chamber 16 has an inlet opening 20, the uppermost portion of which is disposed below the top 19 of the chamber 16. An outlet opening 21 passes through the upwardly facing inner wall portion 18 and leads to a passage 22 which is the high-pressure delivery line of the device. In the passage 22, there is disposed a check valve 23 illustrated in FIG. 1 at the end of a pumping stroke where it is still open. The check valve 23 includes a seat 24 which is integral with the housing 11, which is concentric with the outlet opening 21, and which faces in the direction of flow of the pumped liquid. The valve element of the check valve 23 preferably has a sealing surface which is softer than that of the seat 24 and is normally spring-biased thereagainst. That element includes a pilot or guide for its spring, there being an anvil 25 carried by a sealing plug 26 which limits the extent that the check valve 23 can open.

A container 27 has a loose cover 28 through which the supply of fluid 29 may be replaced. As the uppermost part of the inlet opening 20 is below the top 19 of the fluid chamber 16, the fluid 29 would normally not rise any higher than such level. However, there is here provided a vent opening and plug 30 which, on being removed for venting, limits the height that the liquid can rise in the chamber 16. By this arrangement, the liquid can be kept substantially away from one of the seals described below. Subject to tilting the fluid container 27, the structure can be operated in other positions than that illustrated. For example, the inlet 20 could be placed downwardly or lowermost, and the structure would operate the same. Therefore, terminology contained herein involving words such as "upwardly" or "downwardly" constitute words of relation and are not functionally related to the direction of the force of gravity, whereby the rod 12 could be horizontal.

The rod 12 is slidably supported by a bearing 31, there being a wiper-type seal 32 at the lower end of the bearing 31. If desired, an oil film may be utilized in the space between the moving parts to lessen the likelihood that any air would pass therethrough. The rod 12 is thus slidably mounted for reciprocation along the axis of the outlet opening 21, and at its upper end, the same projects and carries means for altering the effective length of the rod 12, here comprising a cam follower 33 in the form of a cap held in place by a jamb nut 34. A spring 35 acts through a shoulder 36 secured to the rod 12 to normally bias the same in a direction away from the housing 11, against which the other end of the spring bears. A rotatably driven cam 37 carried on a rotatably driven shaft 38 along with the spring 35 comprises means for reciprocating the rod 12. If desired, the spring 35 may be omitted and a positive lifting connection be provided between the cam follower 33 and the cam 37. At any event, the reciprocating means such as 35, 37 has sufficient travel to move the mandrel 14 substantially to the position indicated, and has sufficient travel in the opposite direction to provide a substantial clearance between the lower end of the resilient tubular sleeve 13 and the upwardly facing portion 18 of the inner wall of the housing 11.

Figure 2:
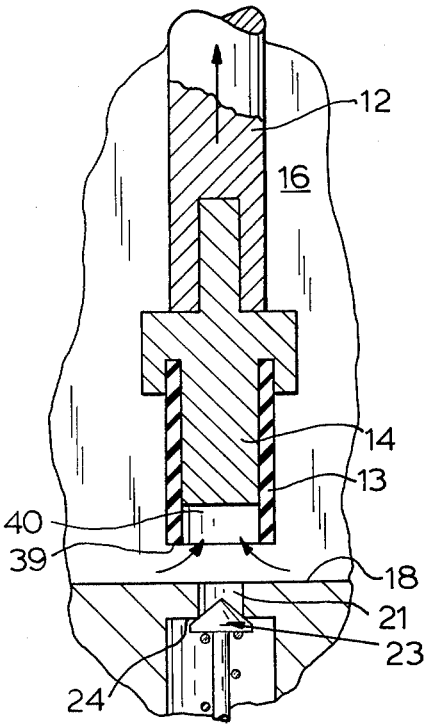
FIG. 2 is an enlarged view of a fragmentary portion of FIG. 1, illustrated at a different point in a cycle.

The upper end of the resilient tubular sleeve 13 is secured to the rod 12 in any convenient manner, and its lower end projects beyond the mandrel, for instance such as shown in the free state in FIG. 2. FIG. 2 is illustrative of upward movement of the rod 12 near its upper limit of travel while FIG. 1 illustrates the lowermost limit of travel of the rod 12 for the particular adjustment or setting of the cam follower 33 that has been illustrated. Downward movement of the rod 12 causes the endmost surface 39 of the sleeve 13 to engage the upwardly facing surface 18 and to form a fluid-tight seal therebetween before the downward movement of the rod 12 has been completed. The space at the lower end of the mandrel 14 surrounded by the projecting portion of the sleeve 13 is referred to as a pumping cavity 40. The diameter of such cavity 40, where round components are used, is a little less than $\frac{1}{4}$ inch in a typical construction, and the axial extent thereof is on the order of 0.040 inch. In other words, the pumping cavity has a volumeric size which is approximately the same as that of a large drop of fluid. At any event, the axial extent of the pumping cavity 40 is somewhat less than its extent taken in a direction transverse to the direction of reciprocable movement.

Figure 6:
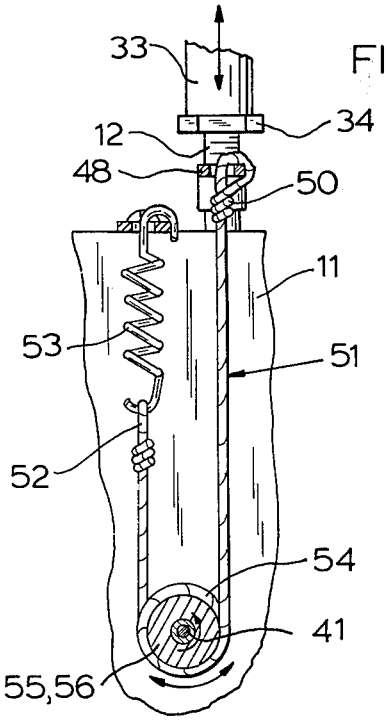
FIG. 6 is a fragmentary elevational view taken along line VI—VI of FIG. 1.

As shown in FIGS. 1 and 6, the stirrer 15 is moveably mounted on the housing 11. The stirrer 15 includes a shaft 41 rotatably supported by a bearing 42, there being a seal 43 of the wiper type which prevents any fluid flow along the shaft 41. A retainer ring 44 is secured to the shaft 41 by pin 45. At the inner end of the shaft 41, there is a plurality of vanes 46, each of which extends radially from the shaft 41 and thence horizontally. Although only three such vanes are illustrated, a typical embodiment includes eight such vanes, the others being omitted for ease of illustration. Each of the vanes 46 is moved through the fluid 29 adjacent to the tubular sleeve 13. The vanes 46 pass successively thereby.

Means are provided which interconnect the rod 12 and the shaft 41, generally indicated by the numeral 47. The means 47 interconnects the rod 12 and the shaft 41 so that reciprocatory movement of the rod moves the shaft 41 in a rotational manner. The structure by which reciprocatory movement is converted into unidirectional rotary movement in either direction includes an arm 48 secured by a pin 49 extending through a hub portion thereof to the rod 12. The hub portion also provides the spring-engaging shoulder 36 mentioned above. At the other end of the arm 48, one end 50 of a flexible cord 51 is connected, and the other end 52 of the cord 51 is secured to the lower end of an extension spring 53 supported by the housing 11. An intermediate portion 54 of the flexible cord 51 is looped about a capstan 55, there being a one-way clutch 56 which connects the outer end of the shaft 41 with the capstan 55. A retainer screw 57 holds the one-way clutch 56 and the capstan 55 on the outer end of the shaft 41. The extension spring 53 maintains the flexible cord 51 in a taut condition, and also pays out and takes up the travel of said other end 52 of the cord 51.

To utilize the device, the fluid 29 is placed in the container 27, and if desired, the air pocket is vented by loosening or removing the screw 30. In order to adjust the pumping rate for a particular speed of rotation of the driving shaft 38, the cam follower 33 is suitably positioned and locked. If it is desired to have maximum pumping capacity, the cam follower 33 an be turned so that the mandrel 14 just touches the upwardly facing portion 18 of the inner wall of the housing 11. To avoid any pounding of parts, the cam follower 33 is given a partial turn so as to provide at least a slight clearance between the mandrel 14 and the surface 18 at the outlet opening 21. With the outlet passage connected to whatever apparatus is to receive the fluid, the device is now ready for pumping at maximum fluid capacity. With a given speed of the drive shaft 38, if it is desired to reduce the capacity, then the cam follower 33 is turned further onto the upper end of the rod 12. The cam 37 has such a profile that the lower end 39 of the resilient tube 13 will always be retracted from the surface 18, thereby permitting the pumping cavity 40 to fill. More specifically, with the pumping cavity 40 full of fluid as shown in FIG. 2, and with the outlet opening 21 being submersed in the fluid and hence full, the rod 12 is moved downwardly until the end 39 of the sleeve 13 forms a tight seal with the surface 18. Continued downward movement builds up a rather high hydrostatic pressure, and when that pressure acting on the face of the check valve 23 is sufficient to overcome the preload of the check valve spring, then the check valve 23 will open as shown in FIG. 1 so that liquid can be forced outwardly. As soon as travel terminates, the check valve recloses. At this point, the resilient tubular sleeve 13 is deformed such as shown in FIG. 1. The cylindrical sides of the mandrel 14 prevent any kind of radially inward collapse of the tubular sleeve 13, and thus its wall can only bulge outwardly as shown. As soon as upward movement of the rod 12 commences, owing to the fact that the high pressure seal is still maintained at the sleeve end 39, a negative pressure is generated within the now-enlarging pumping cavity 40 and just as the seal is broken, that negative pressure is at the maximum, thus causing replacement fluid to flow into the pumping cavity 40. The rod is now readily for a further stroke. Since the pumping cavity is only a little bit larger than the largest drop to be pumped, any air or vapor bubble problem is minimized. If any air bubbles be present in the fluid in the chamber 16, they will tend to rise and collect in the air pocket at the upper end of the chamber, and will not tend to flow into the pumping cavity 40. From time-to-time, any such collected air can be vented as described above. If desired, a plurality of the rods 12 may be utilized in the same housing chamber, and if their outlets are combined and if their pumping strokes are staggered, a rather high number of pulses per second can be obtained with such multiple construction. Where the fluid viscosity is particularly high, then the check valve 23 can be omitted. In other words, if the negative pressure present in the pumping cavity during retraction of the rod 12 is not sufficient to cause any fluid on the high pressure side to flow reversely, then such check valve is not needed. If the viscosity of the fluid is sufficiently low, then the stirrer 15 is not needed.

During downward movement of the rod 12, the one end 50 of the flexible cord 51 is fed downwardly by the arm 48, but the spring 53 keeps it taut and takes up the downward travel of the end 50 with a corresponding upward movement of the other end 52. With the one-way clutch 56 installed in one orientation, the energy stored in the spring 53 will also not only turn the capstan 55, but will act drivingly through the one-way clutch 56 to rotate the stirrer rod 41 by an angular increment. When the rod 12 is returned upwardly, such as by the spring 35, the spring 35 will also act through the arm 48 and the one end 50 of the flexible cord 51 to rotate the capstan 55 in the opposite direction, and to store energy in the extension spring 53. Such movement would produce no rotation of the shaft 41, whereby successive reciprocatory movements of the rod 12 cause the shaft 41 and the vanes 46 to rotate in only one direction. That direction can be reversed by turning the one-way clutch 56 end for end. Under this condition, the contraction of the spring 53 on the downward stroke of the rod 12 uses energy therein to drive the shaft 41. The spring 35 stores energy on downward movement of the rod and gives up energy during upward movement of the rod 12. The extension spring 53 does just the opposite, namely it gives up energy and contracts during downward movement of the rod and receives energy from the spring 35 to store energy therein during upward movement of the rod. With the one-way clutch positioned in one attitude, the upward movement of the rod raises the end 50 of the flexible cord 51 to also directly drive the shaft 41. With the one-way clutch 56 reversed, the upward movement of the other end 52 of the flexible cord 51 effects the rotation of the shaft 41.

With a rather viscous fluid, there is a tendency for the fluid to separate or form pockets therein, and as the successive vanes 46 break up any voids in the fluid, the fluid tends to collapse downwardly so that it is void-free adjacent to the tubular member 13 to enable reliable filling of the pumping cavity 40.

In some instances, the operational parameters may be such that there might not be adequate filling of the pumping cavity 40. If that should take place, then either the structure of FIGS. 3 and 4 or the structure of FIG. 5 may be utilized to ensure accurate metering.

Figure 4:
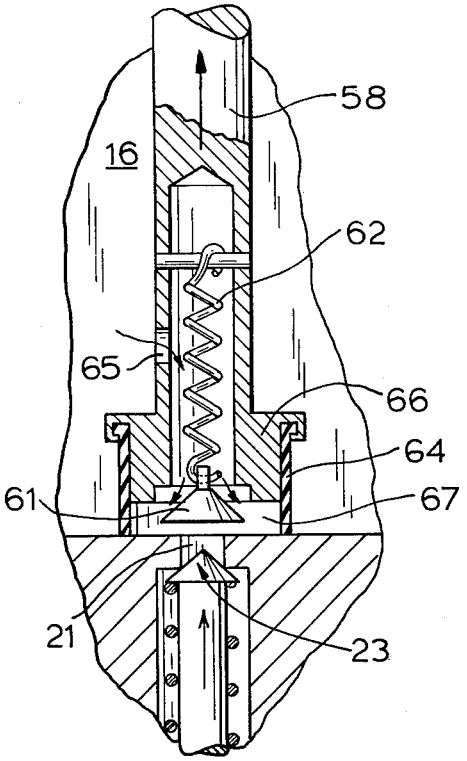

As shown in FIG. 3, a rod 58 has a modified lower end which includes an axial passageway 59 leading to a shoulder 60 that defines a valve seat against which a valve element 61 normally bears. The valve element 61 is biased to a seated or normal position by an extension spring 62 coupled between the valve element 61 and a pin 63 carried by the rod 58. A resilient tubular sleeve 64 is illustrated at the end of the pumping stroke just before the check valve 23 has reclosed. A vent opening 65 communicates the interior of the rod 58 with the fluid that surrounds the lower end of the rod. Just momentarily after the condition illustrated in FIG. 3 has been reached, then the check valve 23 closes by itself, and then thereafter upward movement of the rod 58 begins. Such restoration of the resilient tubular sleeve 64 to its normal position causes a negative pressure to develop in the pumping cavity 67, and just after that negative pressure can overcome the force of the spring 62, the valve 61 will unseat, thus causing fluid to enter the pumping cavity 67 from above, particularly filling the upper portions thereof. If there is any negative pressure remaining when the tubular sleeve 13 unseats, refilling of the pumping cavity will occur as described for FIG. 2. If there isn't any negative pressure remaining, the large ratio of the diameter of the pumping cavity to its axial length will facilitate fluid's flowing in there of itself. Thus there have been provided means at the end of a mandrel 66 which normally bears against the mandrel and which is firmly supported on a pumping stroke, such means being moveable into the pumping cavity 67 due to a negative pressure therein on the return stroke for at least helping in refilling the pumping cavity 67, such means here comprising a check valve seat defined by the shoulder 60 on the mandrel portion of the rod 58 so that fluid can flow axially therethrough from the vent 65.

As shown in FIG. 5 appearing on sheet 1, there again means are provided at the end of a mandrel 68 which are normally held thereagainst and which are firmly supported on pumping strokes and which are moveable into the pumping cavity due to a negative pressure for at least helping in refilling a pumping cavity 69. In this modification a rod 70 has a sealed air pocket 71 communicating with the interior of the mandrel 69 such as through a vent opening 72 which may be replaced with a porous wall. A yieldable moveable diaphragm 73 is normally disposed flatwise against the end of the mandrel that has the opening 72 and which firmly supports it during the pumping stroke. FIG. 5 illustrates the structure on the return stroke of the rod 70 just after a maximum amount of negative pressure has been developed in the pumping cavity 69 which causes the air in the sealed air pocket 71 to expand and to distend the diaphragm 73 as shown until the forces on the opposite sides of the diaphragm have been equalized. When the seal is broken between the lower end of the tubular sleeve 13 and the surface 18, fluid rushes in to refill the pumping cavity 69 and as the air in the air pocket 71 becomes recompressed to its original pressure by fluid acting on the lower side of the diaphragm 73, the diaphragm 73 gradually goes back to its original flat position. In this embodiment, the diaphragm is retained by a retainer ring 74, the periphery of the diaphragm 73 thus being self-sealing.

When the rod 12, 58 or 70 is reciprocated in strokes that are shorter than the maximum permitted, there will be less compression in the pumping cavity of the element defined by the sleeve and mandrel, even though they separate for filling by a substantial amount. A reduced stroke of the rod 12 also reduces the magnitude of movements of the stirrer 15. As the rate of reciprocation of the rod 12 increases, the rate of stirring increments also increases. In that sense, the magnitude or the amount of stirring becomes a function of the volumeric pumping rate.

The shape of the driving cam 37 is not necessarily critical, because a drop can be produced relatively rapidly or relatively slowly, and the return or suction stroke can also be relatively fast or relatively slow. So long as the output pressure is below the leakage pressure at the end of the tubular sleeve this pump operates as a positive displacement device with hydrostatic transfer of the fluid that has already been pumped in a prior stroke. There is virtually no shear of the fluid during the pumping action, enabling latex suspension liquids to be pumped without clogging. The absence of an inlet valve enables the pumping of very small quantities of very thick fluids, even if the fluid contains entrapped air which would make it resilient. By keeping the pumping cavity relatively small, assurance is made that fluid will be pumped and not merely compressed, thus making this pump repeatable in metering and also reliable. The structure is inexpensive. Even if the device is in operation, the cam follower 33 may be adjusted. Further, the flow rate per unit time can be varied by changing the speed of the drive shaft 38. Any small foreign particles that may be in the fluid will pass through the pump with no pump damage, thus enabling solid dispersions to be pumped. If there is any tendency for cavitation to occur at the beginning of a suction or retraction stroke of the rod, a remedy is readily provided by the addition of the feature of FIG. 3 or FIG. 5. The inherent pressure capability of the pump is a function of the construction of the resilient tubular sleeve, the most important parameters being wall thickness of the sleeve, diameter of the sleeve, and length of the sleeve. The basic nominal size of a drop is a function of the inside diameter of the sleeve, which is the mandrel diameter, and the distance that the sleeve extends beyond the end of the mandrel. Where latex fluids are to be pumped, stainless steel and certain plastic parts will readily prevent agglomeration. Other materials may be utilized depending on the fluid to be pumped.

Thus a pump has been provided which can handle difficult-to-pump fluids such as thin or thick latex dispersions without pump clogging due to the build-up of latex particle agglomerates. The pump can be operated at a relatively high speed, such as at least 1,750 strokes per minute for extended periods of time. In some instances, it may be desirable to pressurize the container 27 for some special liquid, but doing so is basically not necessary.

The annular space between the spring of the check valve 23 and the surrounding passage is kept very small, for example, approximately 0.020 inch in thickness to reduce the possibility of air or vapor entrapment.

If it should become necessary to add a thinning solvent to the fluid in the chamber 16, such stirring might create minute vapor bubbles. If such bubble is smaller than the drop size being pumped, the bubble could be pumped. Otherwise, the bubbles would collect in the upper air pocket. The tubular sleeve just simply cannot capture a large bubble as it travels through the fluid.

Another advantage of the pump is that it is self-priming

A horizontal orientation of the rod 12 has been suggested above. This arrangement or attitude may in certain instances improve fluid flow between the end of the tubular sleeve and the inner surface 18 and could also assist in avoidance of vapor bubbles.

Other structure may be utilized to reciprocate the rod 12, such as a linkage.

If 10 of the rods 12 were provided and if the outlets were connected to a common manifold, with the rods 12 being actuated in sequence, with the rotational speed of the shaft 38 at 1800 RPM, there could be produced 300 drops or pulsations per second along with metered flow.

In some applications, it may be desirable to reinforce the tubular sleeve 13 to enable higher operating pressures without leakage between the relatively moveable elements.

The most desirable place for flexure of the tubular sleeve appears to be well up on the side of the wall of the mandrel, away from the surface 18.

The seals 32 may include felt-filled oil wells with the felt in contact with the rod 12 or the bearing 31. The oil acts as a seal to prevent the fluid from traveling along the rod 12 and it also acts as an air barrier to prevent the air from drying fluid on the rod.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. A pump for a fluid comprising:

(a) a housing having a fluid chamber defined by an inner wall, there being an outlet opening in said wall, and said housing having a passage to conduct pumped fluid from said chamber outlet opening;

(b) a rod slidably supported by said housing and projecting therefrom for movement along the axis and said outlet opening;

(c) a resilient tubular sleeve secured to said rod and having an end projecting beyond said rod, said sleeve end being sealingly engageable endwise with said inner wall in surrounding relation to said chamber outlet opening; and (d) a stirrer movably supported by said housing for agitating the fluid in said chamber.

2. A pump according to claim 1, said stirrer including a shaft rotatably carried by said housing, and having a plurality of vanes projecting radially therefrom, and disposed to successively be moved through fluid adjacent to said sleeve.

3. A pump according to claim 1, including means interconnecting said rod and said stirrer for moving said stirrer in response to reciprocation of said rod.

4. A pump according to claim 1, said stirrer being rotatably supported, said interconnecting means including:

(a) an arm secured to said rod and projecting radially therefrom;

(b) a capstan;

(c) a one-way clutch interconnecting said capstan and a portion of said stirrer externally to said housing;

(d) a flexible cord connected at one end to said arm, and being looped drivingly about said capstan at an intermediate portion; and (e) an extension spring connecting the other end of said cord to said housing and maintaining said cord in a taut condition.

5. A pump according to claim 1, said stirrer being rotatably supported, and means connected between said rod and said stirrer for converting reciprocatory movements of said rod into rotary movements of said stirrer.

6. A pump according to claim 5, including means by which rod movements in only one direction effect successive movements of said stirrer in only one direction, whereby reciprocatory rod movements effect incremental rotation of said stirrer in one direction only.

7. A pump according to claim 1, including means for moving said stirrer by an amount that is a function of the volume of fluid pumped.

8. A pump for a fluid comprising:

(a) a housing having a fluid chamber defined by an inner wall, there being an outlet opening in said wall, and said housing having a passage to conduct pumped fluid from said chamber outlet opening;

(b) a rod slidably supported by said housing and projecting therefrom for movement along the axis of said outlet opening;

(c) a resilient tubular sleeve secured to said rod and having an end projecting beyond said rod, said sleeve end being sealingly engageable endwise with said inner wall in surrounding relation to said chamber outlet opening;

(d) a mandrel secured to said rod and projecting into said resilient sleeve, but terminating therein in spaced relation to said sleeve end to define a pumping cavity at the end of said mandrel; and (e) means disposed at the end of said mandrel and normally disposed thereagainst and firmly supported thereby during a pumping stroke of said rod, said means being movable into said pumping cavity during a return stroke of said rod in response to a negative pressure therein, whereby refilling of said pumping cavity is ensured, said means comprising a yieldable diaphragm having a side normally seated against and supported on the end of said mandrel, there being a sealed air pocket within said mandrel communicating with said side of said diaphragm.

9. A pump for a fluid comprising:

(a) a housing having a fluid chamber defined by an inner wall, the lower portion of said chamber being normally filled with the fluid, there being an outlet opening at the bottom of said wall, and said housing having a passage to conduct pumped fluid from said chamber outlet opening;

(b) a rod slidably supported by said housing and projecting therefrom for movement along the axis of said outlet opening; and (c) a resilient tubular sleeve secured to said rod for reciprocation therewith and having an end projecting beyond said rod, said sleeve end being sealingly engageable endwise with said inner wall in surrounding relation to said chamber outlet opening only during a portion of the movement of said rod, whereby the fluid may enter the sleeve by gravity through a clearance between said sleeve end and the adjacent bottom of said inner wall.

10. A pump according to claim 9, said check valve having a seat integral with said housing, concentric with said outlet opening and facing downwardly.

11. A pump according to claim 9, said rod being adapted to be driven toward said outlet opening, and a spring acting between said housing and said rod for moving said rod and said sleeve to insure the clearance between said sleeve end and said inner wall.

12. A pump according to claim 9, including means for reciprocating said rod toward and away from said outlet opening to effect the engagement and disengagement between said sleeve end and said inner wall, and means on said rod for altering its effective length by which the amount of axial compression of said sleeve is determined.

13. A pump according to claim 9, including a mandrel secured to said rod and projecting into said resilient sleeve, but terminating therein in spaced relation to said sleeve end to define a pumping cavity size at the end of said mandrel.

14. A pump according to claim 13, in which the cavity size defined by the magnitude of said spaced relation in the axial direction of said rod is somewhat less than the distance across the adjacent end of said mandrel.

15. A pump according to claim 13, including means disposed at the end of said mandrel and normally disposed thereagainst and firmly supported thereby during a pumping stroke of said rod, said means being movable into said pumping cavity during a return stroke of said solely in response to a negative pressure therein, whereby refilling of said pumping cavity is by gravity ensured.

16. A pump according to claim 9, said housing having a sealed upper end closing the upper portion of said chamber, said housing having an inlet opening to said chamber beneath the uppermost part of said chamber, and a fluid container having a greater capacity than the size of said chamber and communicating therewith by gravity through said inlet opening, whereby an air pocket limits the height of the fluid in the chamber.

17. A pump for a fluid, comprising:

(a) a housing having a fluid storage chamber defined by an inner wall, there being an outlet opening in said wall, and said housing having a passage to conduct pumped fluid from said chamber outlet;

(b) a pair of separable elements jointly defining a sealed pumping cavity communicating with said outlet opening, said elements when separated enabling fluid to fill said cavity by gravity, one of said elements being yieldable to at least partially compress the size of said pumping cavity to force fluid through said outlet opening; and (c) means for moving said elements between positions of separation and cavity compression.

* * * * *